United States Patent [19]

Homko

[11] 4,094,224

[45] June 13, 1978

[54] THREAD PROTECTOR AND SEAL

[75] Inventor: Joseph C. Homko, Oxford, N.J.

[73] Assignee: The United States of America as represented by the Secretary of the Army, Washington, D.C.

[21] Appl. No.: 817,305

[22] Filed: Jul. 20, 1977

[51] Int. Cl.[2] ..... F42B 33/02

[52] U.S. Cl. ..... 86/31; 86/20 B; 141/199; 141/297; 141/331; 285/351

[58] Field of Search ..... 86/23, 31, 20 B; 141/331-345, 297-300, 199-205; 285/257, 322, 347, 351, DIG. 9

[56] References Cited

U.S. PATENT DOCUMENTS

| | | | |
|---|---|---|---|
| 1,899,095 | 2/1933 | Knight et al. | 86/31 |
| 2,435,610 | 2/1948 | Schneider | 86/31 |
| 2,791,148 | 5/1957 | Maisch | 86/31 |
| 4,005,883 | 2/1977 | Guest et al. | 285/322 |
| 4,049,297 | 9/1977 | Reneau | 285/322 |

OTHER PUBLICATIONS

Gask-O-Seal Handbook, Parker Seal Company, 965, Culver City, Calif.

*Primary Examiner*—Harold Tudor
*Attorney, Agent, or Firm*—Nathan Edelberg; A. Victor Erkkila; Max Yarmovsky

[57] ABSTRACT

A thread protector and seal device, suitable for use with automated shell filling equipment utilizes a flanged semi-rigid tubular member having a plurality of longitudinally disposed slots on one end thereof to facilitate insertion into the nose end of an internally threaded projectile. A compliant member is molded into interior and exterior annular grooves of the insertion end of the thread protector to prevent the accumulation of explosive material from entering the threaded fuze area of the projectile during a loading operation.

7 Claims, 5 Drawing Figures

THREAD PROTECTOR AND SEAL

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to prevent explosive materials from entering the internally threaded nose end of a shell casing. The prior art used a molded neoprene flanged tubular member having an externally threaded outside diameter and a smooth inside diameter. The externally threaded portion of the prior art device was manually pushed into the threaded open orifice of the shell casing. The inner bore of the thread protector had a diameter which provided a slight interference fit with a funnel inserted therein so that a seal could be effected between the funnel and the shell. The problem with above mentioned prior art was that the sealing action was not positive because of the frequent variation in diameter tolerances between the molded thread protector and the loading funnel. Experience has shown that it is very difficult to consistently maintain proper tolerences on a molded neoprene member and in addition very difficult to use an automated shell filling operation therewith because the flexibility of the neoprene thread protector made it difficult to pick up and easily insert.

SUMMARY OF THE INVENTION

The present invention relates to a collapsible thread protector seal that seals the internal diameter of a shell component and the outside diameter of a filling funnel during an automated filling operation of a projectile with molten explosive material. The present invention is designed to seal and protect the internally threaded area of a shell being filled from explosive material that normally tends to flow back up into the threaded area surrounding the filling orifice. Contamination of the threaded fuze bore and filling port can cause a subsequent premature explosion when inserting a fuze assembly therein. In addition the present invention protects the internally threaded filling port of the shell from being damaged during the insertion of the funnel by automated filling equipment.

An object of the present invention is to provide a thread protector and seal for a shell casing during the automated filling thereof with a molten explosive through an internally threaded fuze orifice located in the shell's ogive nose end.

Another object of the present invention is to provide a thread protector and seal for an automated explosive material shell filling process which prevents explosive material from flowing back up into a fuze's internally threaded area.

A further object of the present invention is to provide a thread protector and seal for an automated shell filling process which protects an internally threaded filling area of a shell from being damaged during insertion of a filling funnel.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 3:
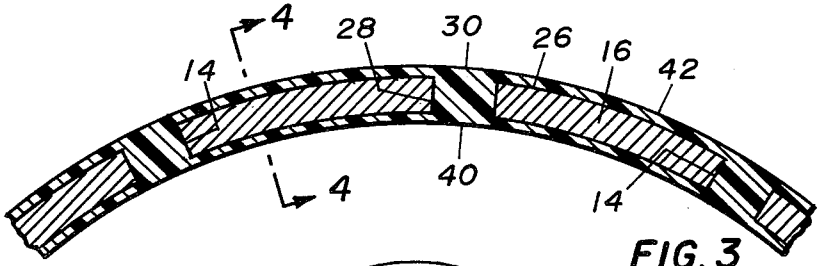
FIG. 3 is a partial cross-sectional view taken along line 3—3 of FIG. 1.
Figure 2:
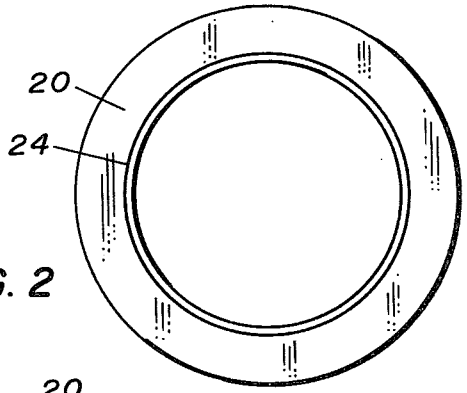
FIG. 2 is a plain view of the thread protector and seal.
Figure 1:
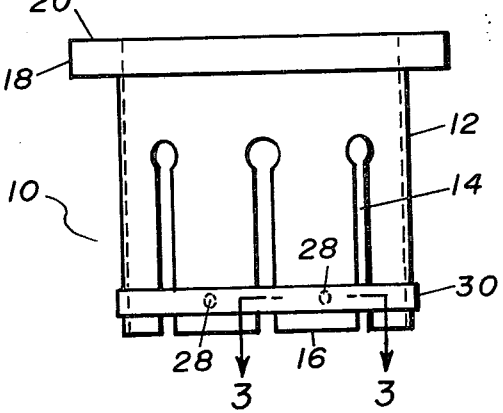
FIG. 1 is an elevational view of the thread protector and seal.

Referring now to FIGS. 1, 2 and 3 the thread protector and seal assembly 10 comprises a tubularly shaped body member 12 having a plurality of parallel longitudinally disposed flexing slots 14 extending through the bottom end 16 and an integral flange 18 on the upper end 20. The bottom flexible end 16 has a pair of annular seal grooves 22 disposed in the interior and exterior walls 24 and 26 respectively of body member 12. The body member 12 may be constructed of a ferrous, nonferrous or plastic material. Intermediate each of the longitudinal slots 14 is a plurality of transversely disposed seal through holes 28 which hold a molded seal band 30 in position at the lower end 16 of the body member 12. The seal band member 30 is molded to the seal body 12 and fixedly held thereto by the seal material being pushed partially into the longitudinal slots 14 and completely in the holes 28 thereby holding the seal body lower end 16 in rivet fashion therebetween as shown by FIG. 3.

Figure 5:
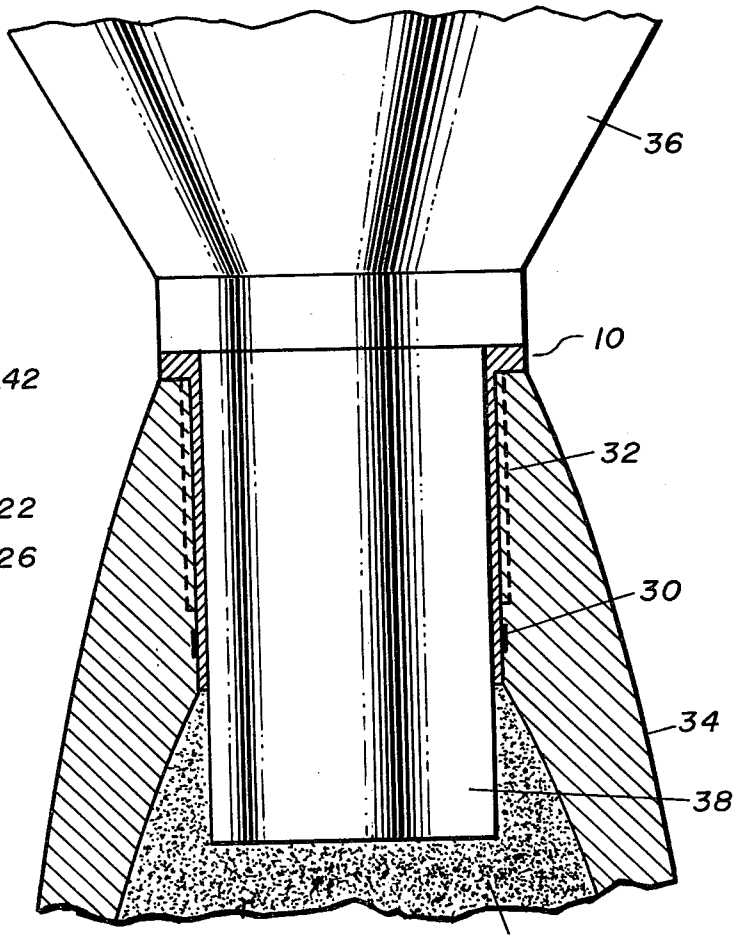
FIG. 5 is a partial diametral cross-sectional view of the thread protector device positioned in the open nose end of a projectile during a funnel loading operation.
Figure 4:
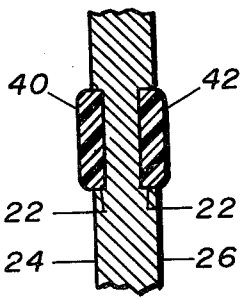
FIG. 4 is a partial cross-sectional view taken along line 4—4 of FIG. 3.

In operation, referring now to FIG. 5, the thread protector and seal assembly 10 is inserted into an internally threaded open end 32 of projectile body 34 prior to the insertion of loading funnel 36 into the open upper end 20 of the body member 12. During the period of time that the funnel 36 is being inserted into the projectile body 34, the threads of internally thread end 32 are protected by the tubular body member 12. Further insertion of the funnel 36 into the thread protector and seal assembly 10 places the outside diameter of the tubular funnel section 38 of the funnel 36 in contact with the interior seal surface 40 of seal band 30 and forces the exterior seal surface 42 against the projectile body 34. The completely inserted funnel 36 thus effects a seal between the funnel section 38 and the projectile 34 preventing explosive charge material 44 from flowing upward into the shell's threaded area.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A thread protector and seal device for use in automated nose end funnel loading of a projectile with explosive materials, which comprises:

a tubularly shaped body member having a plurality of parallel longitudinally disposed flexing slots extending through the bottom end of said body member, annular seal grooves disposed in an interior and an exterior wall of said body member, a plurality of transversely disposed seal through holes positioned in the bottom end of said body member, and an integrally disposed flange located on an upper end of said body member; and molded compliant means located in said interior and exterior seal grooves for preventing injury to internal threads in the nose end of said projectile during funnel loading and for preventing explosive materials from flowing upward into said internal thread area of said projectile.

2. A thread protector and seal device as recited in claim 1 wherein said compliant means comprises a seal band fixedly molded to said interior and exterior annular grooves of said body member and being partially disposed in said flexing slots and filling said seal through holes.

3. A seal thread protector and seal device as recited in claim 2 wherein said tubularly shaped body member is made of a ferrous material.

4. A seal thread protector and seal device as recited in claim 3 wherein said tubularly shaped body member is made of nonferrous material.

5. A seal thread protector and seal device as recited in claim 4 wherein said tubularly shaped body member is made of plastic material.

6. A seal thread protector and seal device as recited in claim 2 wherein said seal is made of molded polyurethane material.

7. A seal thread protector and seal device as recited in claim 6 wherein said seal band is made of molded neoprene rubber material.

* * * * *